US008359947B2

(12) United States Patent
Kaijala

(10) Patent No.: US 8,359,947 B2
(45) Date of Patent: Jan. 29, 2013

(54) RESISTANCE MECHANISM FOR A PEDAL ASSEMBLY

(75) Inventor: Murray Kaijala, Elkhart, IN (US)

(73) Assignee: CTS Corporation, Elkhart, IN (US)

( * ) Notice: Subject to any disclaimer, the term of this patent is extended or adjusted under 35 U.S.C. 154(b) by 238 days.

(21) Appl. No.: 12/877,296

(22) Filed: Sep. 8, 2010

(65) Prior Publication Data

US 2011/0056326 A1 Mar. 10, 2011

Related U.S. Application Data

(60) Provisional application No. 61/276,210, filed on Sep. 9, 2009.

(51) Int. Cl.
*G05G 1/30* (2008.04)

(52) U.S. Cl. ..... 74/512

(58) Field of Classification Search ..... 74/512, 74/513, 518

See application file for complete search history.

(56) References Cited

U.S. PATENT DOCUMENTS

| | | | | |
|---|---|---|---|---|
| 3,885,449 | A | 5/1975 | Green | |
| 5,416,295 | A | 5/1995 | White et al. | |
| 5,634,379 | A | 6/1997 | Barnard | |
| 5,768,946 | A | 6/1998 | Fromer et al. | |
| 5,934,152 | A | 8/1999 | Aschoff et al. | |
| 6,098,971 | A | 8/2000 | Stege et al. | |
| 6,134,987 | A | 10/2000 | Kalsi | |
| 6,167,778 | B1 | 1/2001 | Kohlen | |
| 6,179,081 | B1 | 1/2001 | Engelgau | |
| 6,209,418 | B1 * | 4/2001 | Kalsi et al. | 74/513 |
| 6,220,114 | B1 | 4/2001 | Ray | |
| 6,360,631 | B1 * | 3/2002 | Wortmann et al. | 74/513 |
| 6,418,813 | B1 | 7/2002 | Lewis | |
| 6,758,114 | B2 * | 7/2004 | Sundaresan et al. | 74/512 |
| 2002/0152831 | A1 | 10/2002 | Sakamoto et al. | |
| 2004/0200309 | A1 | 10/2004 | Hasegawa et al. | |
| 2005/0097980 | A1 | 5/2005 | Menzies | |
| 2006/0179972 | A1 * | 8/2006 | Peniston et al. | 74/560 |
| 2007/0000347 | A1 | 1/2007 | Keown et al. | |
| 2008/0276749 | A1 | 11/2008 | Stewart et al. | |
| 2009/0173587 | A1 | 7/2009 | Campbell | |

FOREIGN PATENT DOCUMENTS

| | | | |
|---|---|---|---|
| DE | 44 07 005 | C1 | 3/1995 |
| DE | 102 50 966 | A1 | 5/2004 |
| EP | 0 670 235 | A1 | 9/1995 |
| EP | 0 748 713 | A2 | 12/1996 |
| EP | 0 748 713 | A3 | 4/1998 |
| EP | 0 926 581 | A2 | 6/1999 |
| EP | 1 033 275 | A2 | 9/2000 |
| EP | 0 926 581 | A3 | 5/2002 |
| EP | 0 899 147 | B1 | 10/2003 |
| EP | 0 974 886 | B1 | 9/2004 |
| EP | 1 129 884 | B1 | 3/2005 |
| WO | WO02/39202 | A2 | 5/2002 |

* cited by examiner

*Primary Examiner* — Vicky Johnson
(74) *Attorney, Agent, or Firm* — Daniel J. Deneufbourg

(57) ABSTRACT

A resistance mechanism and module for generating and applying a resistance force to a pedal. The resistance module includes a plunger adapted for movement in the interior of the module between rest and depressed positions in response to the application by the pedal of a compression force against the plunger. The plunger includes an exterior camming surface. An actuator is also located in the interior of the module and includes an exterior camming surface which abuts and is adapted to slide against the camming surface on the plunger in response to the movement of the plunger. A spring in the module abuts and is adapted to apply a biasing force against the actuator. The interaction between the camming surfaces on the plunger and the actuator generates a resistance force which is applied to the pedal.

12 Claims, 8 Drawing Sheets

10
20
26
28
30
31
32
33
34
35
36
38
39
44
48
49
70
72
74
76
78
79
80
82
84
86
88
94
96
98
100
102
104
106
107
110
112
114
116

RESISTANCE MECHANISM FOR A PEDAL ASSEMBLY

CROSS-REFERENCE TO RELATED APPLICATION

This application claims the benefit of the filing date and disclosure of U.S. Provisional Application Ser. No. 61/276,210 filed on Sep. 9, 2009 which is explicitly incorporated herein by reference as are all references cited therein.

FIELD OF THE INVENTION

This invention pertains generally to a vehicle pedal and, more specifically, to a pedal resistance mechanism and module for a vehicle accelerator pedal assembly.

DESCRIPTION OF THE RELATED ART

Some vehicle pedal assemblies in use today are mechanical, typically incorporating a cable or various gears and other transmission devices which convert rotary motion from the pedal into useful mechanical motion. Other pedal assemblies incorporate a position sensor that converts the mechanical position into an electrical signal. In the field of automobiles and trucks, a mechanical bracket using a cable, often referred to as a Bowden cable, is one of the methods used for controlling the throttle of internal combustion engines. These pedal assemblies have a desirable feel and functionality and, with a few refinements, are extremely reliable.

Other pedal assemblies in use today include an electrical linkage between the pedal and the device to be controlled instead of a cable. An electrical linkage is desirable since gear assemblies are bulky, expensive, and limited, due to their inherent size, to those applications where the pedal is very close to the controlled device. While the Bowden cable has proved generally reliable, the penetration of moisture and other contaminants may cause the cable to bind or freeze up during inclement weather.

The substitution of cables with electrical sensors, however, resulted in a poor tactile feel for the operator because the pedal was no longer attached to any mechanical assembly like the cable that provided the required friction and resistance to overcome during operation. Since operators were accustomed to the feel of a mechanical pedal, it has proven desirable to continue this feeling in electronic pedals by incorporating a resistance or kickdown mechanism or module of the type disclosed in, for example, U.S. Pat. No. 6,418,813 to Lewis and assigned to CTS Corporation.

The present invention is directed to an improved resistance or kickdown mechanism and module for a vehicle pedal assembly.

SUMMARY OF THE INVENTION

The present invention is directed generally to a resistance mechanism for a pedal assembly.

The resistance mechanism initially comprises a plunger adapted for depression and linear movement in response to the application of a compressive force thereto and the plunger includes an exterior camming surface. The resistance mechanism also comprises an actuator which includes an exterior camming surface which abuts the camming surface on the plunger and is adapted for linear movement in response to the linear movement of the plunger. The resistance mechanism still further comprises a biasing device which abuts against the actuator and is adapted to apply a biasing force against the actuator.

According to the invention, the camming surfaces on the plunger and the actuator respectively slide against each other in response to the compression force applied to the plunger and the biasing force applied against the actuator to allow the creation and adjustment of a resistance force which is applied by the plunger to the pedal assembly.

In one embodiment, the resistance mechanism comprises a separate module or cartridge which defines an interior housing for the plunger, the actuator, and the biasing device and the module is fitted in the interior of a cavity defined in the pedal of the pedal assembly.

In one embodiment, the plunger and the actuator are both adapted for linear movement within first and second respective cavities defined in the module and the actuator is disposed in the second cavity in the module at an angle relative to the plunger in the first cavity of the module.

Further, in one embodiment, the plunger includes respective proximal and distal ends. The proximal end projects out of an opening defined in one of the walls of the module and the distal end projects out of an opening defined in another of the walls of the module. The camming surface is defined on a side surface of the plunger. The actuator includes respective interior and exterior surfaces. The camming surface on the actuator is defined on the exterior surface and the biasing device abuts against the interior surface of the actuator.

Still further, in one embodiment, the module defines an interior surface and the actuator includes at least first and second arms each of which includes an exterior surface adapted to slide against the interior surface of the module.

Additionally, in one embodiment, the respective camming surfaces on the plunger and the actuator each include a plurality of interconnected sloped segments which interact and cooperate with each other to generate the resistance force which is applied by the plunger to the pedal.

In one embodiment, at least two of the plurality of camming segments on the plunger abut and slide against at least two of the plurality of camming segments on the actuator.

There are other advantages and features of this invention which will be more readily apparent from the following detailed description of the embodiment of the invention, the drawings, and the appended claims.

BRIEF DESCRIPTION OF THE DRAWINGS

In the accompanying drawings that form part of the specification, and in which like numerals are employed to designate like parts throughout the same.

DETAILED DESCRIPTION OF THE EMBODIMENT

Figures 1, 2:
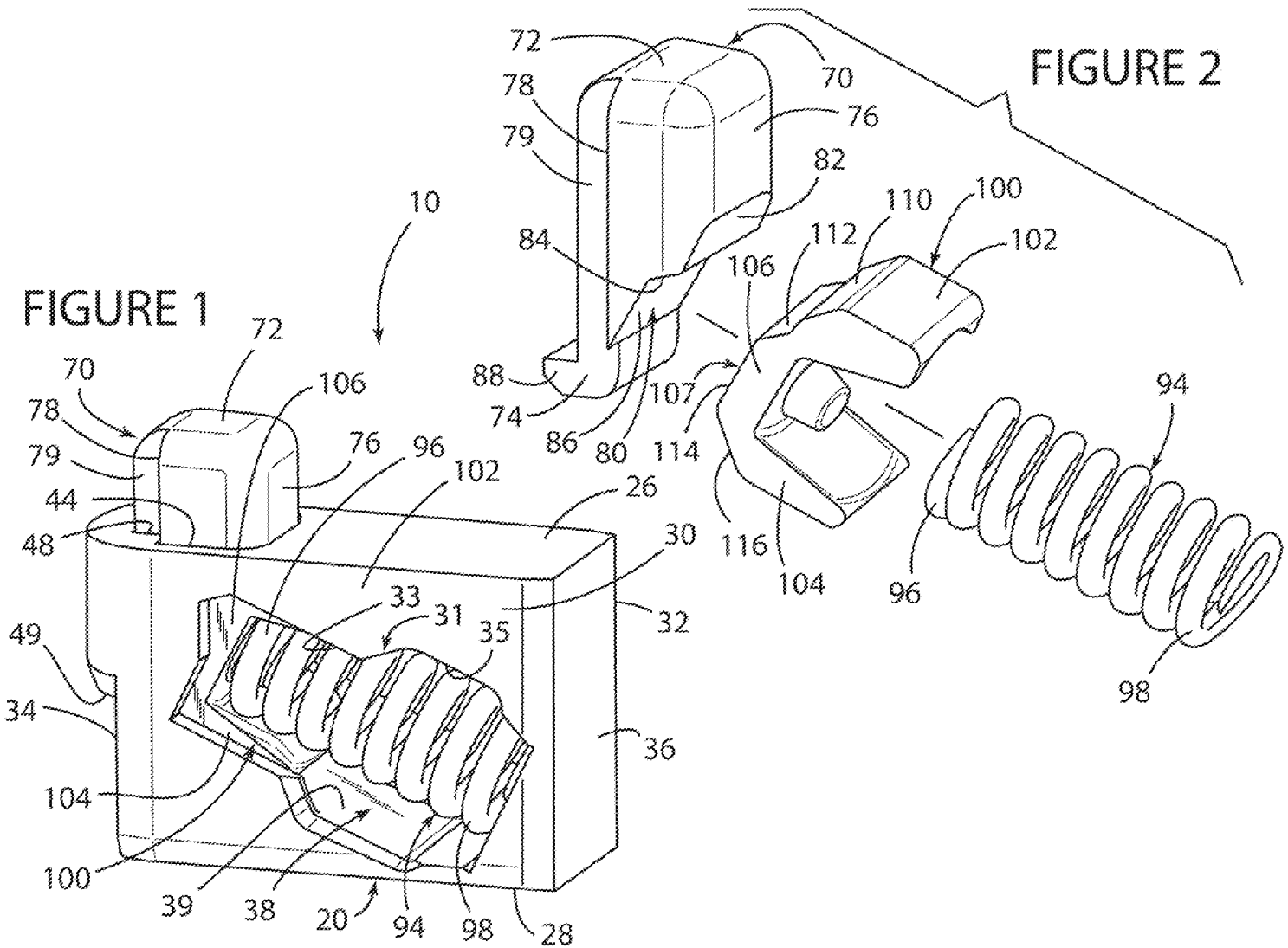
FIG. 1 is an enlarged, perspective view of a pedal resistance mechanism and module in accordance with the present invention.
FIG. 2 is an enlarged, exploded perspective view of the plunger, the actuator, and the spring biasing device of the pedal resistance mechanism and module shown in FIG. 1.
Figure 4:
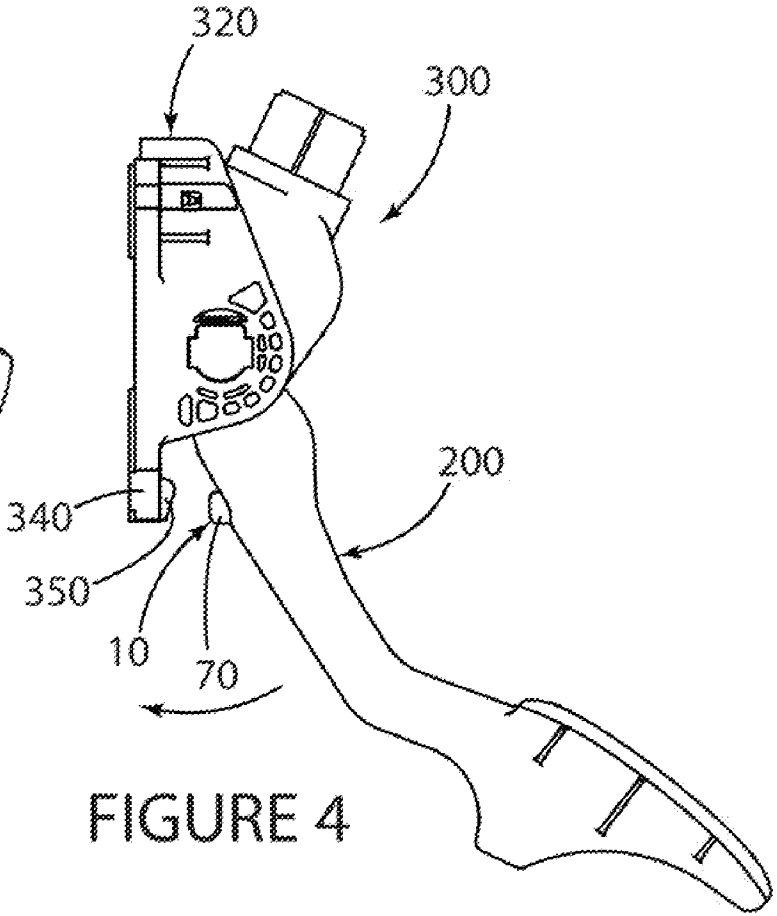
FIG. 4 is a side elevational view of a pedal assembly incorporating the pedal shown in FIG. 3.
Figure 3:
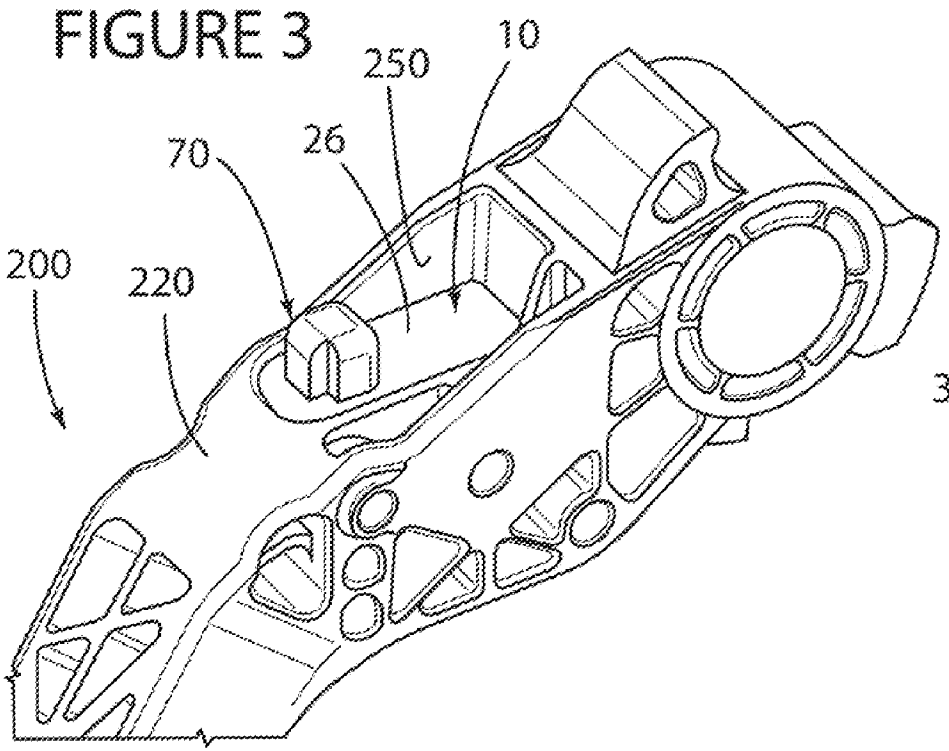
FIG. 3 is a perspective view of the pedal resistance mechanism and module of FIG. 1 fitted into the interior cavity of a vehicle pedal.

FIG. 1 shows a pedal resistance or kickdown mechanism and module 10 in accordance with the present invention which is adapted to generate, apply, and allow for the adjustment of a resistance force which is applied to a vehicle pedal and thus the foot of the driver of a vehicle. The pedal can be an accelerator pedal of the type shown in FIGS. 3 and 4.

Resistance or kickdown mechanism and module 10 has a generally rectangularly-shaped housing or case or cartridge 20 which, in one embodiment, is adapted to be press-fitted and retained in the interior cavity 250 defined in the underside surface 220 of a pedal arm 200 of the type shown in FIG. 2. The pedal arm 200, in turn, is adapted for coupling and use in a pedal assembly 300 of the accelerator type shown in FIG. 4 wherein the pedal arm 200 is coupled and adapted for rotation relative to a housing 320 in response to the depression of the pedal arm 200 by the foot of a vehicle operator in the direction of a base 340. The base 340 is located opposite the pedal arm 200 and, more specifically, opposite the kickdown mechanism and module 10 fitted in the pedal arm 200. The plunger 70 of the kickdown mechanism and module 10 is adapted to contact a raised and angled stop 350 on the top surface of the base 340 in response to the rotation of the pedal arm 200 into contact with the base 240 and cause the activation of the kickdown mechanism and module 10 as discussed in more detail below.

Referring back to FIG. 1, in one embodiment, the housing 20 may be formed from machined steel. In another embodiment, the housing 20 may be formed from molded plastic. Housing 20 defines six exterior sides or surfaces or walls including opposed generally horizontally oriented top and bottom surfaces or sides or walls 26 and 28; opposed generally vertically oriented front and back sides or surfaces or walls 30 and 32; and opposed generally vertically oriented end sides or surfaces or walls 34 and 36 (FIG. 2).

The end wall 34 (FIGS. 1 and 5-9) defines an elongate opening (not shown) for the finger 88 of a plunger 70 as described in more detail below. The front wall 30 defines an opening 31 including a narrow region 33 and a wide region 35. The opening 31, which extends and slopes downwardly at about a 45 degree angle from a point adjacent the upper left corner of the housing 20 and the end wall 34 thereof to a point adjacent the lower diametrically opposed right corner of the housing 20 and the opposed end wall 36 thereof, leads into a bore or cavity 38 (FIGS. 1 and 5-9) which is defined in the interior of the housing 20.

The bore 38 is defined by at least lower and upper opposed, spaced-apart and generally parallel interior surfaces 39 and 41 respectively which also extend and slope downwardly at about a 45 degree angle between the opposed end side walls 34 and 36.

A generally square-shaped opening 44 (FIGS. 1 and 5-9) is defined in the top wall 26 adjacent the edge of the housing 20 which joins the end wall 34 and the top wall 26. Opening 44 extends into a generally vertically oriented cavity 53 (FIGS. 5-9) defined in the interior of the housing 20 by a circumferentially extending and generally vertically oriented interior housing surface 50 (FIGS. 5-9) which opens into the upper end of the bore 38. Thus, in the embodiment shown in the FIGURES, the interior cavities 38 and 53 are generally disposed in the interior of the housing 20 at a 45 degree angle relative to each other. The cavity 53 extends in the housing 20 generally between the top and bottom walls 26 and 28 thereof.

The top wall 26 additionally defines a smaller opening 48 (FIG. 1) which is unitary with the opening 44 and leads and extends into a generally vertically oriented and elongate interior channel (not shown) which is defined in the interior surface of the end wall 34 of the housing 20 and opens into the cavity 53.

The resistance or kickdown mechanism and module 10 additionally comprises an elongate, generally square-shaped piston or plunger 70 which is mounted for reciprocating up and down linear movement in and through the opening 44 and the cavity 53 in the housing 20 in a relationship and direction generally normal to the top and bottom housing walls 26 and 28. The plunger 70 may be formed from either molded plastic or machined steel. The plunger 70 includes opposed upper and lower distal spaced-apart ends 72 and 74 respectively (FIGS. 2 and 5-9) and four circumferentially extending side faces including opposed front and back spaced-apart faces 76 and 78 respectively.

The back face 78 of the plunger 70 includes an elongate rib or key 79 (FIGS. 1 and 2) projecting outwardly therefrom and extending between the respective upper and lower ends 72 and 74 of the plunger 70. The back face 78 and, more specifically, the rib 79 thereof, additionally defines and terminates in the distal finger 88 which projects generally normally outwardly from the exterior surface of the rib 79 adjacent the lower end 74 of the plunger 70.

The plunger 70 is oriented and mounted in the housing 20 in a generally vertical relationship generally normal to the top housing wall 26 and adjacent and parallel to the vertical housing end wall 34. In the normal, disengaged orientation of the resistance mechanism and module 10, the upper end 72 of the plunger 70 protrudes out of the housing 20 and, more specifically, out of the opening 44 defined in the top wall 26 thereof. The body of the plunger 70 extends through the interior housing cavity 53. The lower end 74 and, more specifically, the finger 88 of the plunger 70 protrudes outwardly from the opening (not shown) defined in the end wall 34 of the housing 20 as shown in FIGS. 5-9. Moreover, and as shown in FIG. 1, the rib 79 extends into the channel (not shown) defined in part by the opening 48 in the top wall 26 of the housing 20 and guides the linear movement of the plunger 70 through the cavity 53 in the housing 20.

As shown in greater detail in FIGS. 2 and 5-9, the front face 76 of the plunger 70 includes a camming surface 80 which slopes and angles simultaneously rearwardly in the direction of the back face 76 of the plunger 70 and downwardly in the direction of the lower end 74 of the plunger 70 at about a 45 degree angle relative to the front face 76 of the plunger 70. In the embodiment shown, the camming surface 80 starts at a point generally midway along the front face 76 and terminates at a point adjacent the lower end 74 of the plunger 70.

The plunger camming surface 80 has a plurality of angled, generally flat interconnected camming surfaces or segments 82, 84, and 86. Segment 82 is angled and slopes simultaneously inwardly and downwardly from the generally vertical front face 76 of the plunger 70 in the direction of the back vertical wall 78 and the distal end 74 of the plunger 70; the segment 84 is angled and slopes further simultaneously inwardly and generally downwardly from the lower edge of the segment 82 also in the direction of the back plunger face 78 and the distal end 74 thereof; and the segment 86 is angled and slopes simultaneously rearwardly and downwardly from a lower edge of segment 86 also in the direction of the back vertical wall 78 and into the distal end 74 of the plunger 70.

Thus, in the depicted embodiment, the angled segments 82 and 86 define respective end camming segments disposed and oriented at the same angle relative to the front and back plunger faces 76 and 78 and thus are designed and oriented relative to each other in a generally spaced and parallel relationship. Camming segment 84 extends between the camming segments 82 and 86 at an angle different than the segments 82 and 86.

With continued reference to FIGS. 2 and 5-9, resistance mechanism and module 10 additionally comprises a biasing device in the form of a coil spring 94 which is also located in the bore or cavity 38 of the housing 20 and, as described in more detail below, is adapted to exert a biasing force against an actuator 100 which, in turn, biases the plunger 70 out of the cavity 53 and the housing 20. Spring 94 has opposed proximal and distal ends 96 and 98 respectively. Distal end 98 rests against a sloped interior end housing wall 42 (FIGS. 5-9) while the proximal end 96 rests against the interior surface of an actuator 100 as described in more detail below. The end housing wall 42 is located at the lower end of the bore 38 and the lower right corner of the housing 20 and extends between the lower edges of the lower and upper surfaces 39 and 41 respectively of the bore 38.

As discussed briefly above, the resistance mechanism and module 10 additionally comprises a generally unitary U-shaped actuator 100 (FIGS. 2 and 5-9) including diametrically opposed arms 102 and 104 extending generally normally outwardly from the opposed ends of a central base 106 and further including an exterior camming surface 107 (FIGS. 2 and 5-9). The interior surface of each of the arms 102 and 104 is generally concave and adapted to receive and cradle the distal end 96 of the spring biasing device 94. Actuator 100 can be formed from metal or plastic.

The actuator 100 is introduced into the housing 20 during the assembly process through the wide region 35 of the opening 31 in the front wall 30 of the housing 20 and is pushed inwardly and upwardly into the bore 38 of housing 20 into a relationship wherein the exterior camming surface 107 thereof is abutted against the exterior camming surface 80 defined on the front face 76 of the plunger 70 as shown in FIGS. 5-9; the exterior surface of the arm 102 is abutted against the interior housing surface 41; and the exterior surface of the arm 104 is abutted against the opposed interior housing surface 39.

Also, during the assembly process, the coil spring 94 is introduced into the housing 20 through both the narrow and wide regions 33 and 35 defined in the opening 31 into the relationship as described above wherein the end 96 rests against the interior surface of the base 106 and is cradled between the arms 102 and 104 of the actuator 100, and the opposed distal end 98 is abutted against the surface of the interior housing wall 42.

In the embodiment shown, the exterior camming surface 107 of the actuator 100 includes four differently flat and interconnected camming surface segments 110, 112, 114, and 116 (FIGS. 2 and 5-9) of which the segments 112 and 114 are adapted to interact with and slide against the camming segments 82 and 84 on the camming surface 80 of the plunger 70 as described in more detail below.

Segment 110 extends generally downwardly and outwardly from an inside edge of the exterior surface of the upper arm 102 of the actuator 100. The segment 112 extends generally outwardly and downwardly from a lower edge of the segment 110. The segment 114 extends generally downwardly from a lower edge of the segment 112 in the direction of the lower arm 104. The segment 116 extends generally inwardly and downwardly from a lower edge of the segment 114 and terminates in an inside edge of the exterior surface of the lower arm 104 of the actuator 100.

In accordance with the invention, actuator camming segments 110 and 112 on the actuator 100 are disposed and oriented at the same angle and slope relative to each other and also at the same angle and slope as the camming segment 84 on the camming surface 80 of the plunger 70. The actuator camming segment 114 is disposed and oriented at the same angle and slope as the camming segment 86 on the camming surface 80 of the plunger 70. Moreover, in the embodiment shown, the actuator camming segments 110 and 112 on the one hand and the actuator camming segment 116 on the other hand diverge away from each other and the upper and lower edges respectively of the central actuator camming segment 114.

Referring to FIGS. 5-9, the plunger 70 is adapted to slide and move linearly and vertically downwardly into the opening 44 and through the cavity 53 defined in the interior of the housing 20 in a direction generally normal to the housing wall 26 in response to the application of an external compressive inward force against the end 72 of the plunger 70 when the plunger 70 contacts the stop 350 on the base 340 of the pedal assembly 300.

The spring 94 has a natural biasing force which urges or moves the plunger 70 outwardly out of the housing 20 when no external compressive force is applied to the end 72 of the plunger 70.

Figure 5:
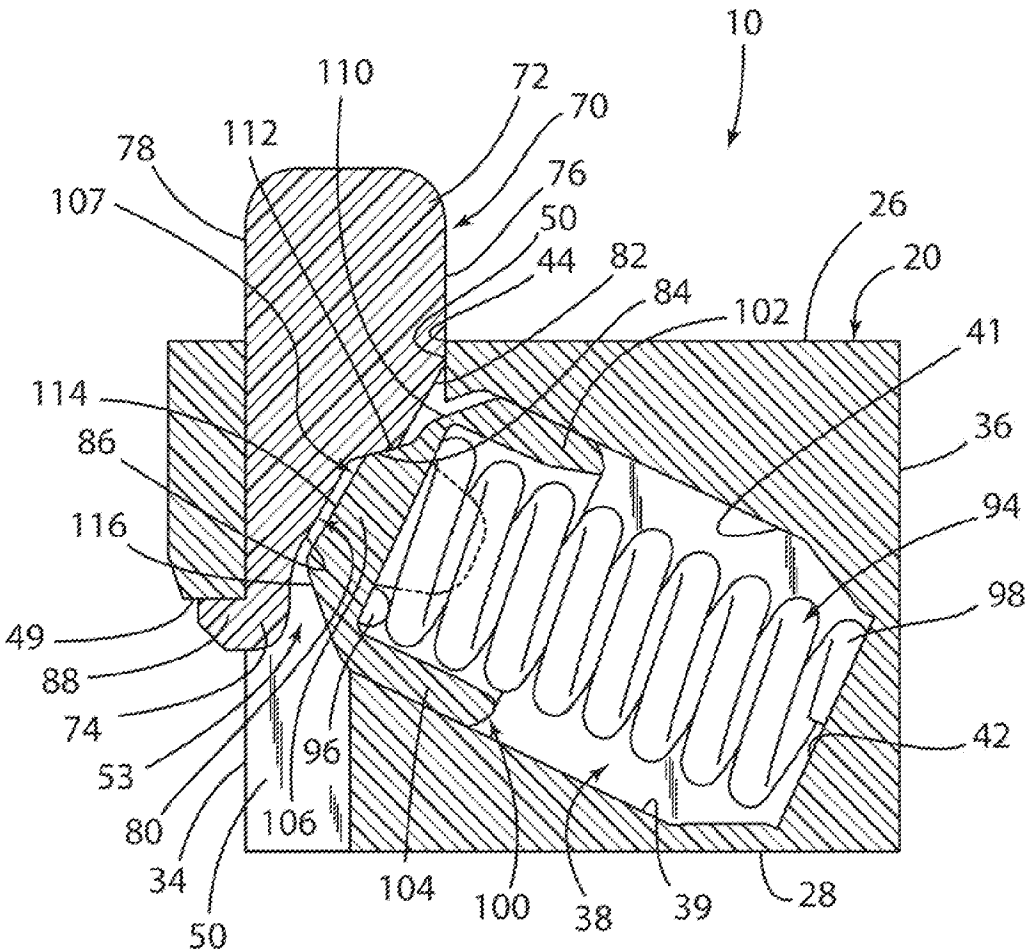
FIGS. 5-9 are enlarged, vertical cross-sectional views of the pedal resistance mechanism and module shown in FIG. 1 and depicting the plunger and associated resistance generating components thereof in their respective different linear positions therein in response to the travel of the plunger within the housing thereof.

In the extended or rest position of the resistance mechanism and module 10 and the plunger 70 as shown in FIGS. 1 and 5 when no external compressive forces are being applied to the end 72 of the plunger 70, the spring 94 and, more specifically, the biasing force of the spring 94 as described above, holds the plunger 70 in a biased relationship with the end 72 thereof projecting out of the housing 20; the camming segment 84 of the plunger 70 abutted against the camming segment 112 of the actuator 100; and the finger 88 at the distal end 74 of the plunger 70 abutted against the exterior face of the shoulder 49 projecting outwardly from the end wall 34 of the housing 20 at a point located generally midway along the length of the end wall 34 of the housing 20.

Figure 6:
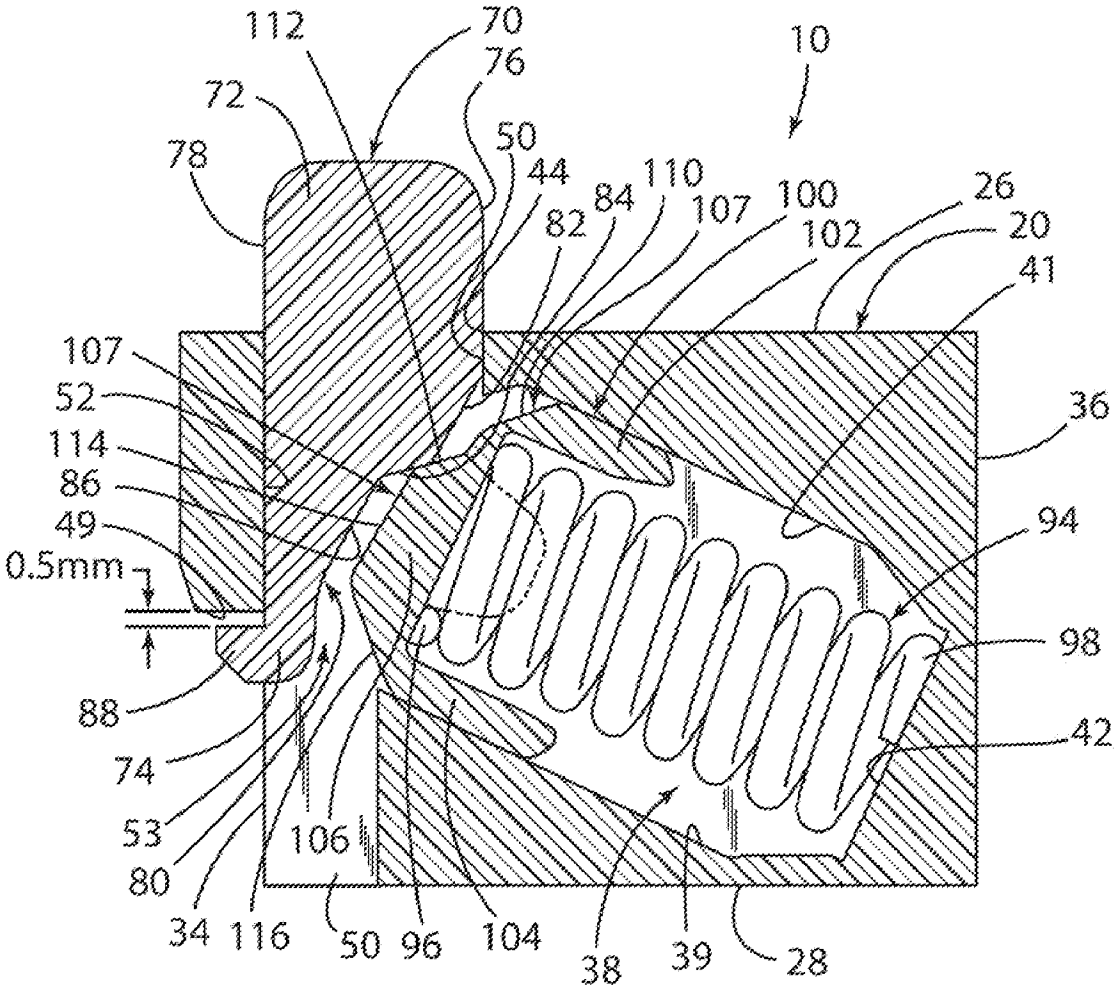

When a large enough magnitude external compressive force is applied against the end 72 of the plunger 70 (as a result of the depression of the pedal arm 200 into contact with the stop 350 on the base 340) to overcome the combination of the opposed biasing force of the spring 94, the friction force between the abutting plunger and actuator camming surfaces 84 and 112 respectively, and the opposing friction forces between abutting actuator and interior housing surfaces and arms 39 and 104 respectively and 41 and 102 respectively, the plunger 70 is depressed (i.e., is moved linearly inwardly and downwardly into the cavity 53 in the housing 20 a distance of about 0.5 mm) as shown in FIG. 6 which causes the respective plunger and actuator camming surfaces 84 and 112 to slide against each other in a manner which causes the actuator 100 to slide linearly downwardly in the cavity 38 in the housing 20 in the direction of the interior housing end surface 42 and the front end wall 36 of the housing 20 and causes the compression of the spring 94.

The depression of the plunger 70 as shown in FIG. 6 also causes the finger 88 at the distal end 74 of the plunger 70 to move downwardly a distance of about 0.5 mm away from the shoulder 49 formed on the back end wall 34 of the housing 20 and in the direction of the bottom wall 28 of the housing 20.

In accordance with the present invention, the angle and slope of the abutting camming segments 84 and 112 in part determines the magnitude of the compressive force which will be necessary to overcome the biasing and friction forces as described above and cause the movement of the plunger 70 into the housing 20.

Also, when the plunger 70 is depressed, the interaction between at least the respective abutting plunger and actuator camming surfaces, the spring biasing force, and the surface friction forces as described above, causes the pedal resistance mechanism and module 10 to create and generate a pedal resistance force that is transmitted through the plunger 70 and into the pedal arm 420 and is applied to the foot of the user.

Figure 7:
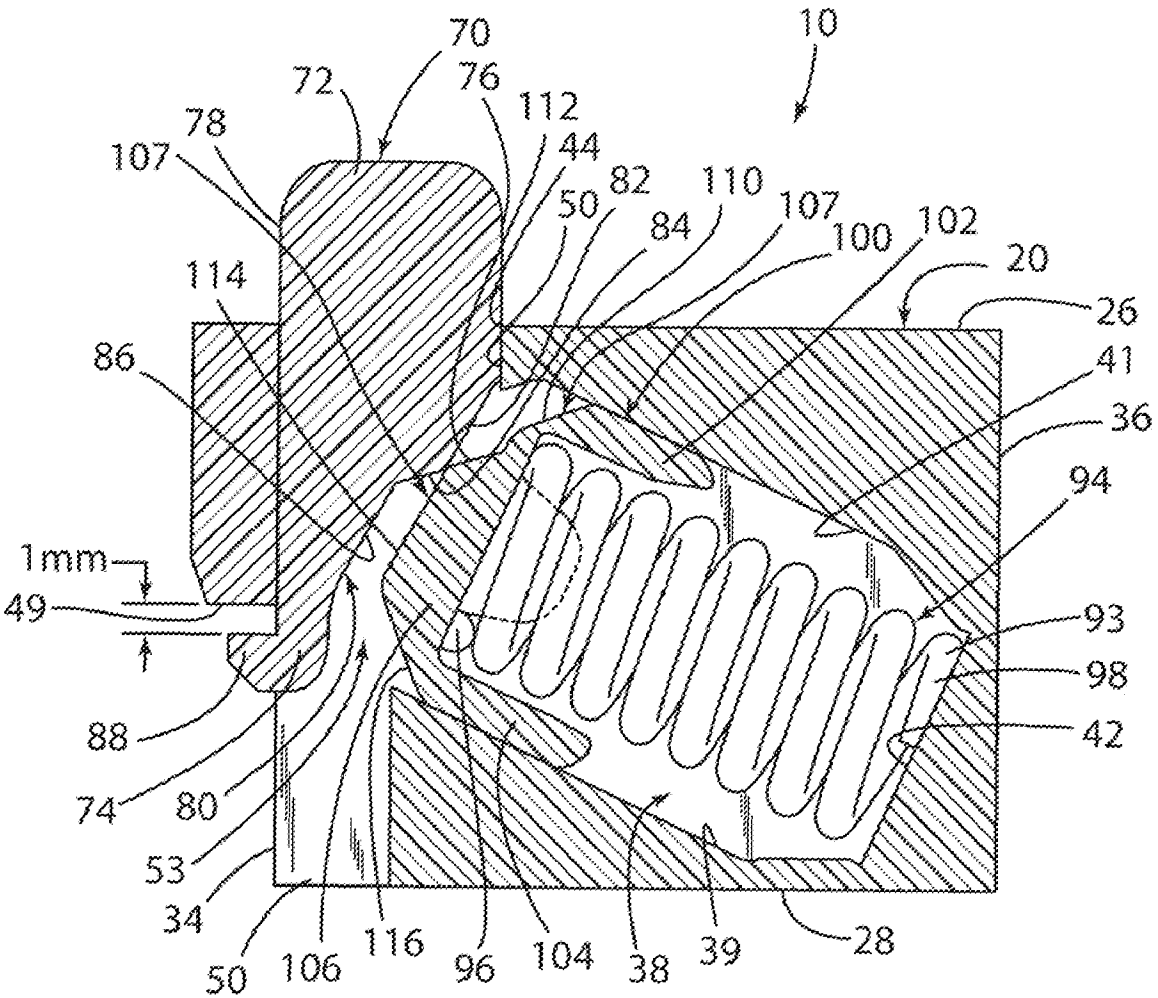

As shown in FIG. 7, the continued depression of the plunger 70 (in response to the continued depression of the pedal arm 200) causes the continued sliding of the plunger camming segment 84 relative to and against the camming actuator segment 112 into a relationship wherein an upper edge of the plunger camming segment 84 is abutted against a lower edge of the actuator camming segment 112 (i.e., the peak point of the pedal resistance force) causing the actuator 100 to slide further downwardly and inwardly and linearly into the cavity 38 of housing 20 and in the direction of the interior housing surface 42 thereof which, in turn, causes the further compression of the coil spring 94.

The continued depression of the plunger 70 a distance of about 1 mm inward into the cavity 53 as shown in FIG. 7 also causes the finger 88 on the plunger 70 to move still further downwardly a distance of about 1 mm away from the shoulder 49 on the housing 20 in the direction of the bottom housing wall 28.

Figure 8:
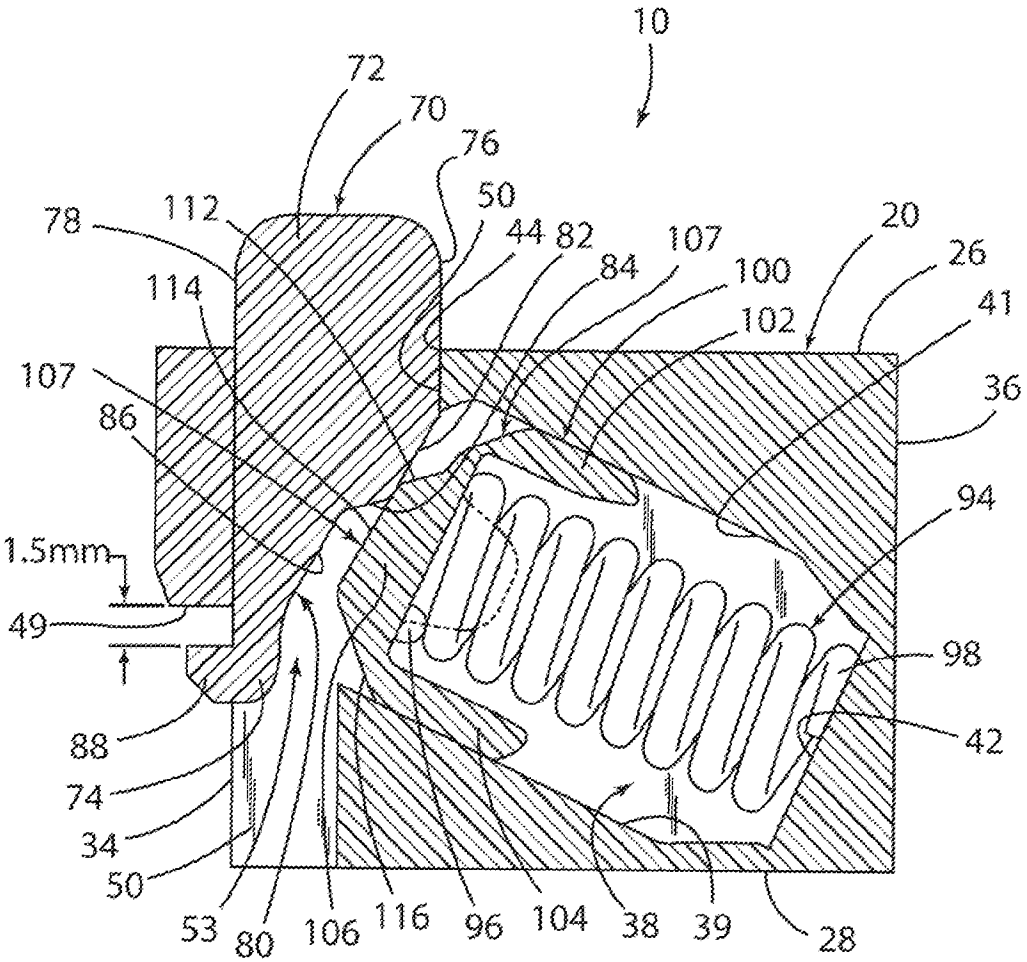

As shown in FIG. 8, the still further continued depression of the plunger 70 (in response to the still further continued depression of the pedal arm 200) causes the upper edge of the camming segment 84 of the plunger 70 to slide past the lower edge of the actuator camming segment 112 into a relationship wherein the plunger camming segment 82 is positioned in abutting relationship with and against the actuator camming segment 114 to cause the further inward and downward movement of the actuator 100 into the housing cavity 38 and in the direction of the interior housing surface 42 which, in turn, causes the still further compression of the spring 94.

The still continued depression of the plunger 70 a distance of about 1.5 mm inwardly into the cavity 53 as shown in FIG. 8 also causes the finger 88 on the plunger 70 to move even still further downwardly a distance of about 1.5 mm away from the shoulder 49 on the housing 20 in the direction of the bottom housing wall 28.

Figure 9:
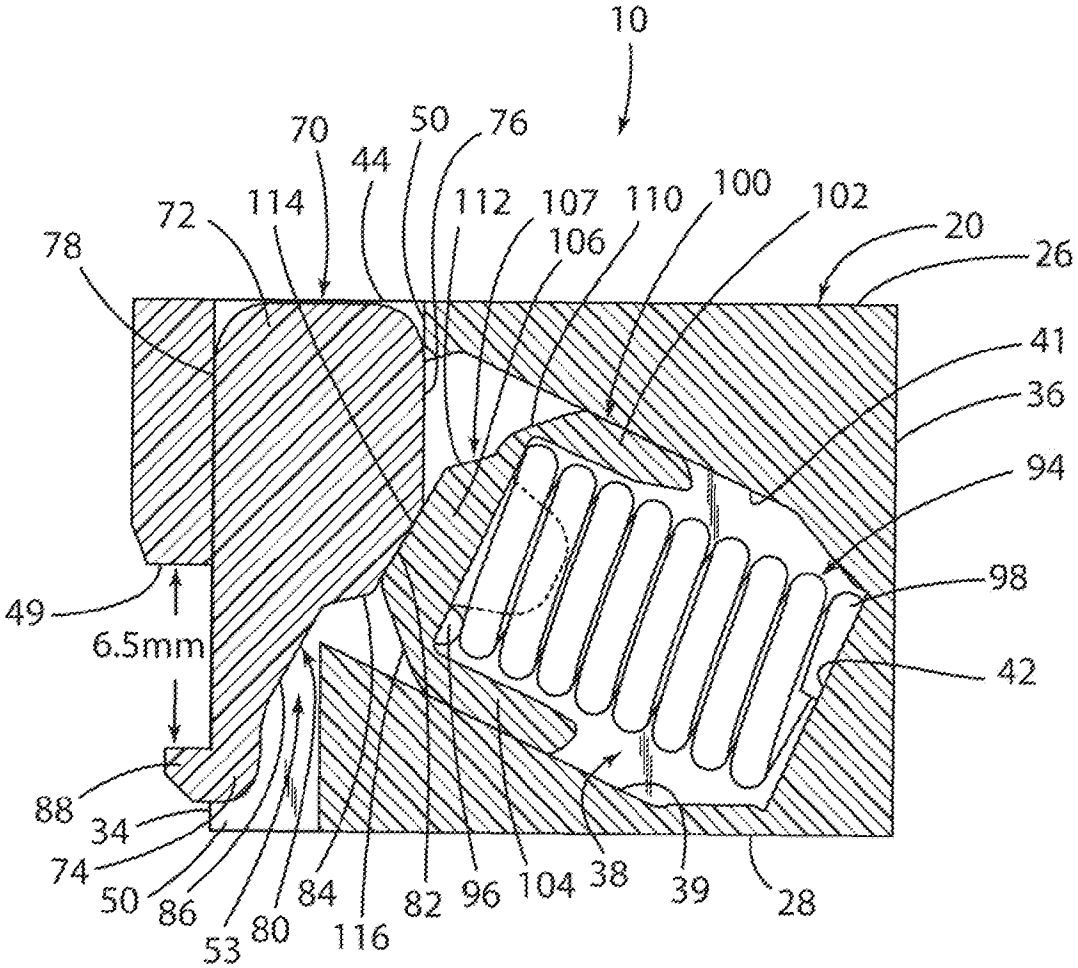

FIG. 9 depicts the position of the plunger 70, the actuator 100, and the spring 94 in the housing 20 after the plunger 70 has traveled a distance of approximately 6.5 mm inwardly into the cavity 53 of the housing 20 and, more specifically, into a relationship in which the plunger camming segment 82 is fully abutted against the actuator camming segment 114; the actuator 100 is fully extended into the cavity 38 of the housing 20; and the spring 94 has been fully compressed in the cavity 38.

In the position of FIG. 9, the finger 88 at the distal end 74 of the plunger 70 is located a distance of 6.5 mm away from the shoulder 49 on the back end housing wall 34.

Although not shown in any of the FIGURES, it is understood that the release of the compressive force applied against the plunger 70 (through the release of pressure on the pedal arm 200) causes the spring 94 and, more specifically, the biasing force therein, to move the plunger 70 back up to its original rest or stop position as shown in FIG. 5 and described in detail above.

Figure 10:
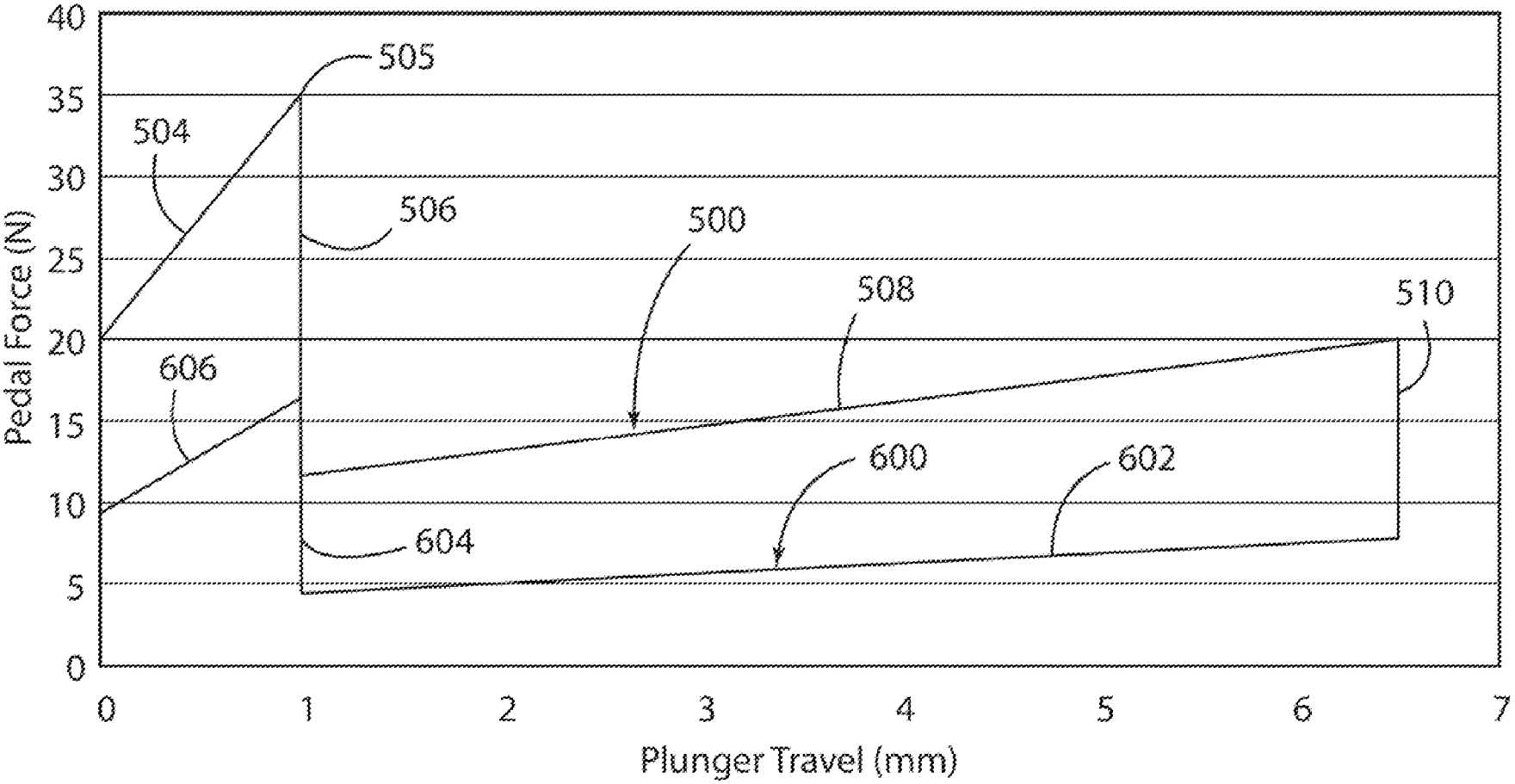
FIG. 10 is a graph of pedal force versus plunger travel for the resistance mechanism and module of FIG. 1.

A graph of pedal force versus travel of the plunger 70 for the module 10 is shown in FIG. 10. The upper graph line 500 is a representation of the pedal force versus plunger travel effect in response to rotation of the pedal arm 200 in a manner causing the travel of the plunger 70 from the rest position of FIGS. 1 and 5 to the fully depressed position of FIG. 9.

The lower graph line 600 is a representation of the pedal force versus plunger travel effect for module 10 as a user removes pressure from the pedal arm 200 thus removing pressure on the plunger 70 and causing the plunger 70 to move from its FIG. 9 position back to its FIGS. 1 and 5 rest positions.

With continued reference to FIG. 10, it is understood that a pedal force greater than approximately 20 N is required to overcome the combination of the biasing force of the spring 94, the friction force of the abutting plunger and actuator camming surfaces, and the friction force of the abutting actuator and housing surfaces and cause the displacement of the plunger 70 into the housing 20 from its FIG. 5 resting position.

The region 504 on the graph line 500 depicts the increase in the pedal resistance force (i.e., the force acting against the foot of the vehicle operator and against the depression of the pedal) which occurs between 0 mm and 1 mm of travel of the plunger 70 linearly inwardly and downwardly into the cavity 53 of the housing 20 as shown in FIGS. 6 and 7.

The point 505 on the graph line 500 represents the peak or highest point or magnitude of the pedal resistance force which occurs when the plunger 70 and the actuator 100 and, more specifically, the respective camming segments 84 and 114, are abutted against each other as shown in FIG. 7.

The region 506 on the graph line 500 exhibits the first sharp vertical drop-off in pedal resistance force which occurs between the plunger position of FIG. 7 (1 mm of plunger travel) and the plunger position of FIG. 7 (1.5 mm of plunger travel) when the sharp upper edge of the plunger camming segment 84 clears the sharp lower edge of the actuator camming segment 112. The region 508 on the graph line 500 exhibits the over-travel position of the module 20 and the resultant slight gradual and continual increase in the pedal resistance force in response to the continued depression of the plunger 70 in the housing 20 from 1 mm (FIG. 7) to about 6.5 mm (FIG. 9).

The region 510 on the graph line 500 exhibits the second sharp drop-off in the pedal resistance force when the plunger 70 has completely overcome the biasing force of the coil spring 94, the friction force of the abutting plunger and actuator camming surfaces, and the friction force of the abutting actuator and housing surfaces.

The region 602 on the graph line 600 exhibits the slight but continued drop-off in pedal resistance force as the plunger 70 travels back out of the housing 20 from its FIG. 9 position (6.5 mm of plunger travel) to its FIG. 7 position (1 mm of plunger travel). The region 604 on the graph line 600 depicts the sharp increase in pedal resistance force which occurs upon return of the plunger 70 to its FIG. 7 position.

The region 606 on the graph line 600 exhibits the reduction in the pedal resistance force as the plunger 70 is moved rearwardly out of the housing from its FIG. 7 position back to its FIG. 5 rest position.

Numerous variations and modifications of the embodiment described above may be effected without departing from the spirit and scope of the novel features of the invention. It is thus understood that no limitations with respect to the specific mechanism and module illustrated herein are intended or should be inferred. It is, of course, intended to cover by the appended claims all such modifications as fall within the scope of the claims.

For example, it is understood that the invention also covers the embodiment wherein the plunger 70, the actuator 100, and the coil spring 95 are all appropriately located, mounted and interconnected directly in the cavity 250 of the pedal arm 220 rather than in a separate housing 20. It is also understood that the module 10 and/or the plunger 70, the actuator 100, and the coil spring 95 could also be located and mounted in the base 340 of the vehicle pedal assembly 300 rather than in the pedal arm 220.

What is claimed is:

1. A resistance mechanism for a pedal assembly comprising:

a plunger adapted for depression and linear movement in response to the application of a compressive force thereto, the plunger including an exterior camming surface having at least a first sloped flat segment;

an actuator including an exterior camming surface having at least a first sloped flat segment abutting against the at least first sloped flat segment of the camming surface on the plunger and adapted for linear movement in response to the linear movement of the plunger, the actuator being disposed at an obtuse angle relative to the plunger; and a biasing device abutting against the actuator and adapted to apply a biasing force against the actuator, the biasing device abutting against the actuator and disposed at an obtuse angle relative to the plunger;

whereby the at least first sloped flat segment of the camming surfaces on the plunger and the actuator respectively slide against each other in response to the compression force applied to the plunger and the biasing force applied to the actuator to allow the adjustment of a resistance force applied by the plunger to the pedal assembly.

2. The resistance mechanism of claim 1 further comprising a separate module defining an interior housing for the plunger, the actuator, and the biasing device, the module being adapted to be fitted in the interior of a cavity defined in the pedal assembly.

3. The resistance mechanism of claim 2, wherein the plunger includes respective proximal and distal ends, the proximal end projecting out of the module and the camming surface being defined on a side surface thereof, the actuator including respective interior and exterior surfaces, the camming surface on the actuator being defined on the exterior surface and the biasing device abutting against the interior surface of the actuator.

4. The resistance mechanism of claim 3, wherein the housing of the module defines an interior surface, the actuator including a base and at least first and second arms extending from the base and each including an exterior surface adapted to slide against the interior surface of the housing of the module, the camming surface on the actuator being defined on the base of the actuator.

5. The resistance mechanism of claim 1, wherein the respective camming surfaces on the plunger and the actuator each include at least first and second interconnected flat sloped segments which interact and cooperate with each other.

6. A resistance mechanism for a pedal assembly comprising:

a housing including an interior surface defining an interior cavity;

a plunger including a proximal end projecting from the housing and adapted to engage with the pedal assembly and a distal end extending into the cavity, the plunger being moveable in the housing in response to the application by the pedal assembly of a compressive force against the proximal end of the plunger; and a resistance assembly in the cavity of the housing for applying a resistance force to the pedal assembly including:

a camming surface on the plunger, the camming surface on the plunger having at least a first camming segment with a first slope and a second camming segment connected to the first camming segment and having a second slope different than the first sloe of the first camming segment;

a moveable actuator including a camming surface abutting against the camming surface on the plunger and the interior surface of the housing, the camming surface on the actuator having at least a first camming segment with a first slope and a second camming segment connected to the first camming segment and having a second slope different than the first slope of the first camming segment; and a biasing device abutting against the actuator and adapted to apply a biasing force to the actuator and the plunger;

wherein the first camming segments of the camming surface on the plunger and the actuator respectively and the second camming segments of the camming surface on the plunger and the actuator respectively abut against each other in response to movement of the plunger to allow the adjustment of the resistance force applied to the pedal assembly.

7. The resistance mechanism of claim 6, wherein the biasing device adapted to apply a biasing force against the actuator and the plunger is a coil spring including a proximal end abutting against the actuator and a distal end abutting against an interior surface of the housing.

8. The resistance mechanism of claim 7, wherein the actuator includes a base having respective exterior and interior surfaces and a pair of opposed and spaced-apart arms extending from the base, the camming surface on the actuator being defined on the exterior surface of the base and the interior surface of the base abutting against the proximal end of the coil spring.

9. The resistance mechanism of claim 6, wherein the housing is in the form of a cartridge defining the interior cavity and adapted to be fitted in a pedal of the pedal assembly, the plunger extending in the cartridge in a relationship generally normal to one of the walls of the cartridge and the interior cavity extending through the cartridge in an angled relationship relative to the one of the walls of the cartridge.

10. A resistance mechanism for a pedal assembly comprising:

a housing defining an interior cavity;

a plunger including a proximal end projecting from the housing and adapted to engage with the pedal assembly and a distal end extending into the cavity, the plunger being moveable in the housing in response to the application by the pedal assembly of a compressive force against the proximal end of the plunger; and a resistance assembly in the cavity of the housing for applying a resistance force to the pedal assembly including:

a camming surface on the plunger;

a moveable actuator including a camming surface abutting against the camming surface on the plunger; and a biasing device abutting against the actuator and adapted to apply a biasing force to the actuator and the plunger;

wherein the camming surfaces on the plunger and the actuator interact and cooperate with each other in response to movement of the plunger to allow the adjustment of the resistance force applied to the pedal assembly, the housing being in the form of a cartridge defining the interior cavity and adapted to be fitted in a pedal of the pedal assembly, the plunger extending in the cartridge in a relationship generally normal to one of the walls of the cartridge and the interior cavity extending through the cartridge in an angled relationship relative to the one of the walls of the cartridge the cartridge including at least a first side wall defining an elongate opening and including an exterior shoulder protruding outwardly therefrom, the plunger including a finger extending through the elongate opening and adapted to abut against the exterior shoulder of the sidewall of the cartridge.

11. A resistance module for a vehicle pedal comprising:

a housing defining first and second interior cavities oriented relative to each other in an oblique angled relationship, the second interior cavity being defined by an interior surface;

a plunger adapted for linear movement within the first cavity in response to the application of a compressive force thereto, the plunger including a proximal end protruding from an opening defined in one of the walls of the housing and a distal end projecting from an opening defined in another of the walls of the housing, the plunger including an exterior camming surface;

an actuator adapted for linear movement within the second interior cavity in the housing and oriented relative to the plunger in an oblique angled relationship, the actuator including a base and a pair of spaced-apart arms extending from the base and the base of the actuator including a camming surface on an exterior surface of the base abutting against the exterior camming surface on the plunger, the pair of spaced-apart arms of the actuator abutting against the interior surface defining the second cavity of the housing; and a biasing device located in the second interior cavity, the biasing device including one end abutted against an interior surface of the actuator and adapted to exert a biasing force against the actuator and the plunger;

wherein the depression of the plunger into the housing causes the sliding of the camming surfaces on the plunger and the actuator against each other, the sliding of the pair of spaced-apart arms of the actuator against the interior surface defining the second cavity in the housing, the linear movement of the actuator, and the compression of the biasing device.

12. The resistance module of claim 11, wherein each of the camming surfaces on the plunger and the actuator include a plurality of interconnected flat camming segments having different slopes, at least two of the plurality of flat camming segments on the plunger being adapted to abut and slide against at least two of the plurality of flat camming segments on the actuator for generating a resistance force which is applied to the vehicle pedal.

* * * * *